US005996121A

United States Patent [19]

Harris

[11] Patent Number: 5,996,121

[45] Date of Patent: Dec. 7, 1999

[54] CONVERTIBLE COAT

[76] Inventor: Eunice Harris, P.O. Box M424, Gary, Ind. 46401-0424

[21] Appl. No.: 08/835,799

[22] Filed: Apr. 15, 1997

Related U.S. Application Data

[63] Continuation of application No. 08/582,468, Jan. 3, 1996, abandoned, which is a continuation of application No. 08/098,431, Jul. 28, 1993, abandoned.

[51] Int. Cl.[6] ..... A41B 1/00

[52] U.S. Cl. ..... 2/69; 2/85; 2/93; 2/108; 2/69.5; 383/4; 224/577

[58] Field of Search ..... 2/69, 69.5, 70, 2/71, 72, 86, 88, 89, 94, 105, 106, 108, 1, 74, 75, 79, 80, 83, 90, 113–116, 125, 128, 85, 93, 95, 243.1, 912–915; 224/151, 577, 153; 383/4; 150/100, 103, 106, 107

[56] References Cited

U.S. PATENT DOCUMENTS 1,948,177 2/1934 Karasic .
2,109,951 3/1938 Truesdell et al. .
3,846,844 11/1974 Graf .
4,055,853 11/1977 Argento et al. .
4,426,740 1/1984 Reverberi .
4,475,251 10/1984 Hopkins .
4,637,076 1/1987 Tartt et al. .
4,651,348 3/1987 Swanson .
4,862,520 9/1989 Gazzola .
5,097,534 3/1992 Viemeister et al. .

*Primary Examiner*—Gloria Hale
*Attorney, Agent, or Firm*—Richard G. Kinney

[57] ABSTRACT

A long-sleeved full-skirt coat that may be manually converted into a shoulder tote bag. A shoulder strap is formed from the long sleeves by attaching their free ends together. The bag is formed by transversely folding the flattened body of the coat with the arms spread-eagled to either side. The body is folded in approximately three sections from top to bottom. The bottom third skirt section has its corners folded inward to form a generally pointed bottom which is folded over the top third and fastened to the front of the coat body. The free ends of the sleeves are then fastened together to form a shoulder strap extending from either end of the folded and fastened together body. The front center of the coat has zippered pockets which are accessible and usable when the coat is converted to a shoulder bag.

10 Claims, 4 Drawing Sheets

CONVERTIBLE COAT

This application is a continuation of application Ser. No. 08/582,468, filed on Jan. 3, 1996, now abandoned, which is a continuation of application Ser. No. 08/098,431, filed Jul. 28, 1993, now abandoned.

FIELD OF THE INVENTION

This invention relates to a coat which may be converted into a shoulder bag, or tote bag with a shoulder length strap, and to the method of making such a conversion.

BACKGROUND OF THE INVENTION

When a coat comes off and there is no where to put it, there is a need to minimize the number of items that the bearer must carry. Whether shopping, attending a sports event, traveling, or walking with small children, it is preferable not to have to hold onto both a coat and a handbag as separate items.

Several inventors have addressed the need to combine the functions of a coat and a handbag into one item. U.S. Pat. No. 4,862,520 (1989) shows a coat with a backpack element covering the full back portion of the coat, thus, compromising the fashion integrity of the coat itself for the purpose of utility. U.S. Pat. No. 4,475,251 (1984) displays the handle means and several components of the handbag attached to the inside of the jacket, rendering the fashion of the jacket's interior compromised when the jacket is opened. U.S. Pat. No. 4,055,853 (1977) discloses the belt of the coat as handle means when the garment is converted into a tote bag. This method cannot accommodate coats without belts. Other prior art references of possible interest are U.S. Pat. Nos: 1,948,177; 2,109,951; 3,846,844; 4,426,740; 4,637,076; 4,651,348 and 5,097,534. There is therefore a need for a convertible garment/shoulder tote bag which can be formed from a long-sleeved coat that may be beltless; in addition to a need for increased focused upon fashion integrity—along with utility—of the invention.

SUMMARY OF THE INVENTION

A coat constructed in accordance with the principles of the present invention has long sleeves with fastening means at their free ends to form a shoulder strap and has provision for allowing the body of the coat to be folded transversely about the span between the place the sleeves are attached to the body and fastened in that folded configuration to form a bag-like arrangement with the sleeves projecting from opposite sides of the bag and forming a shoulder strap therefore.

Advantages

Accordingly, some advantages of the present invention are to minimize the number of items that a person must carry when a coat has been removed and must be kept with the person because there is no place to put it; and to incorporate a coat and a tote bag into one item which houses and accesses personal items when the invention is in either mode. Further advantages of the present invention are:

(a) . . . to provide a convertible coat/tote bag which utilizes an element other than the belt of the coat as handle means for the tote bag; and (b) . . . to provide a convertible coat/tote bag which utilizes an element other than a strap or other device housed on the inside of the coat as the handle means for the tote bag; and (c) . . . to provide a convertible coat/tote bag which is sleek and compact in either mode.

Further advantages will become apparent from a consideration of the ensuing description and drawings.

The present invention is a convertible outer garment of dual-purpose, without any indication that when being worn as a coat, it is a shoulder bag. Nor is there evidence that, when being utilized as a shoulder bag, it is also a coat.

The conversion is accomplished by folding of the coat, and mated fasteners that hold the coat in its folded position while it is being used as a tote bag. There is no disassociation of parts. Every part of the coat is also a part of the tote bag and vice versa.

Pockets house personal items which the wearer can access when the invention is in either mode. These pockets are made operative via conventional zippers, in the preferred embodiment.

The coat may be made from a variety of flexible sheet materials such as rayon, nylon, polyester, denim, cotton, wool, or a blend of such types of materials. The most favorable results will be accomplished with the use of lightweight fabric which does not wrinkle easily when folded.

The style of the garment is not critical to the invention as the garment's length may be either to-the-knee, below-the-knee, or above-the-knee. The collar may be of varying size or style, or it may be non-existent. The number of pockets may increase by placing pocket openings in discreet locations such as along fold lines or seams. The function of the mated fasteners may be equally fulfilled by hooks-and-loops, buttons and holes, or snaps. The use of these variations is totally dependent upon the preference of the designer.

Although the description contains many specifications, these should not be construed as limiting the scope of the invention, but as merely providing illustrations of some of the presently preferred embodiments of this invention.

Thus, the scope of the invention should be determined by the appended claims and their legal equivalents, rather than by the example given.

The invention, together with further advantages and features thereof, may best be understood by reference to the following description, taken in connection with the accompanying drawings, in the several figures of which like reference numerals identify like elements.

Figure 1:
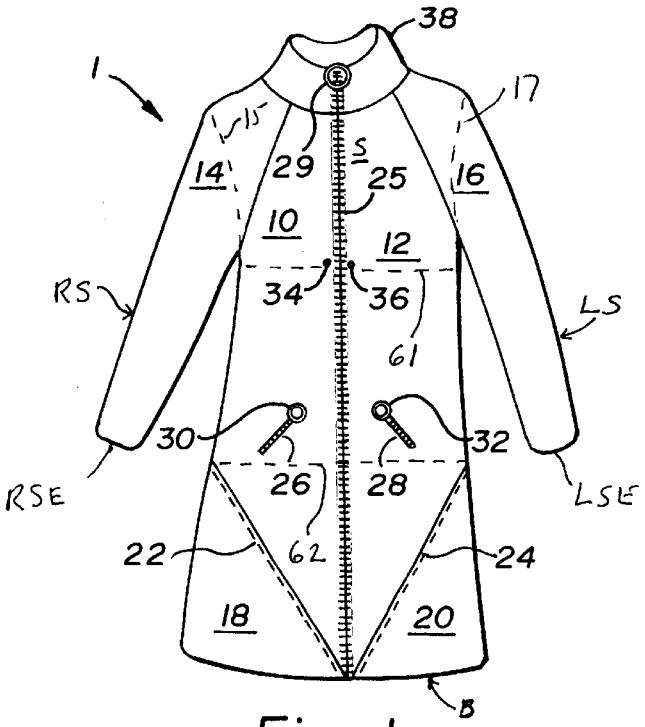
FIG. 1 illustrates the front of the garment or coat in a laid out, flat, semi spread-eagle array such as would result from the coat being laid out on a table or other horizontal surface.

| Reference Numerals in Drawings | |
|---|---|
| 10 front top right | 12 front top left |
| 14 sleeve front right | 16 sleeve front left |
| 18 front bottom right | 20 front bottom left |
| 22 front fold line right | 24 front fold line left |
| 25 longitudinal zipper | 26 pocket right |
| 28 pocket left | 29 longitudinal zipper pull |
| 30 zipper pull right | 32 zipper pull left |
| 34 snap receptacle right | 36 snap receptacle left |
| 38 collar | 40 back top left |
| 42 back top right | 44 back bottom left |
| 46 back bottom right | 48 sleeve back left |
| 50 sleeve back right | 52 sleeve fastener left |
| 54 sleeve fastener right | 56 back fold line |
| 58 hidden snap left (FIG. 5) | 60 hidden snap right (FIG. 5) |

DETAILED DESCRIPTION

Referring now more particularly to the drawings, FIG. 1 provides a front view of a coat 1 constructed according to the invention. The coat 1 is a full-length coat with long sleeves LS and RS and a body section B. The coat is made from a flaccid garment sheet material conformed to fit the human body. The front is comprised of the following components: front sections 10, 12, 18, and 20; right sleeve-shoulder front section 14 and left sleeve-shoulder section 16; and collar 38. The sleeves RS and LS extend from approximately dashed lines 15 and 17 in FIGS. 1 and 2 to the free ends RSE, LSE of the sleeves. Between the sleeves is a span of the top portion S of the body.

The front and back 10, 12, 40, 42 collectively define what is here termed the body of the coat with an open bottom and a head receiving top opening. The right sleeve 14 and left sleeve 16 are attached to the body and extend on either side of the body. The body defines a span of cloth between the sleeves about which span the body is folded to form the bag. The free ends of the sleeves have mated fastening means that allow the sleeves to be joined together to form a shoulder strap or handle.

The front of the coat is completely and equally separated into a front top right 10 and a front top left 12 by a longitudinal separating zipper 25 extending from the garments' top to its bottom. Located approximately midway between the longitudinal zipper and each side of the coat is a pocket opening leading to pocket right 26 or pocket left 28. Each pocket opening is also located approximately halfway between the top and bottom of the coat, and is accessible by means of a zipper which is opened and closed with zipper pull right 30 or zipper pull left 32. Front fold lines 22 and 24, may be, as shown, indicated on the front of the body B, by top-stitching which delimits front bottom sections 18 and 20. The fold lines 29 and 24 run from the approximate center of the bottom or hem of the coat body B to the side at about fold zipper and each side of the coat is a pocket opening leading to pocket right 26 or pocket left 28. Each pocket opening is also located approximately halfway between the top and bottom of the coat, and is accessible by means of a zipper which is opened and closed with zipper pull right 30 or zipper pull left 32. Front fold lines 22 and 24, may be, as shown, indicated on the front of the body B, by top-stitching which delimits front bottom sections 18 and 20. The fold lines 29 and 24 run from the approximate center of the bottom or hem of the coat body B to the side at about fold line 62. Snap receptacles 34 and 36 (which are mated with hidden snaps 58 and 60 FIG. 5) are located near the longitudinal zipper, approximately one-third of the distance between collar 38 and bottom of the coat. Sleeve front sections—sleeve right front 14 and sleeve left front 16—are adjacent to collar 38 and right front 10 and left front top 12.

Figure 2:
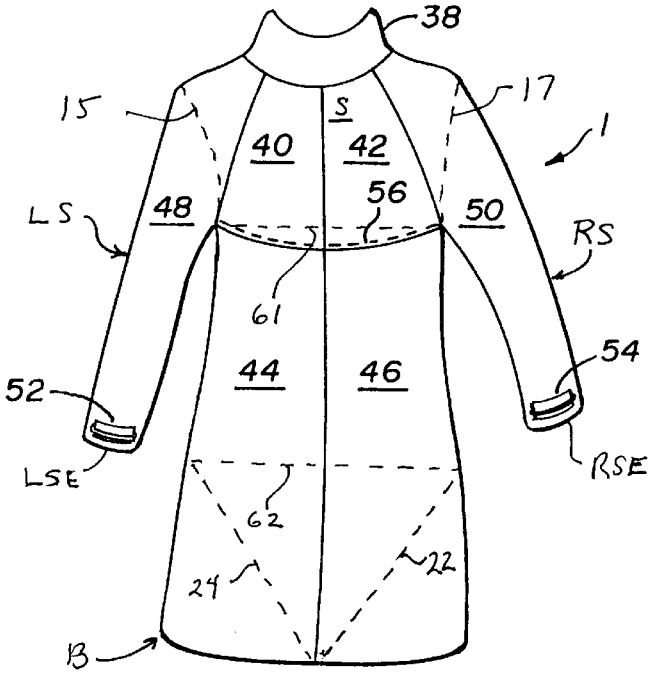
FIG. 2 illustrates the back of the garment similarly laid out.
Figure 5:
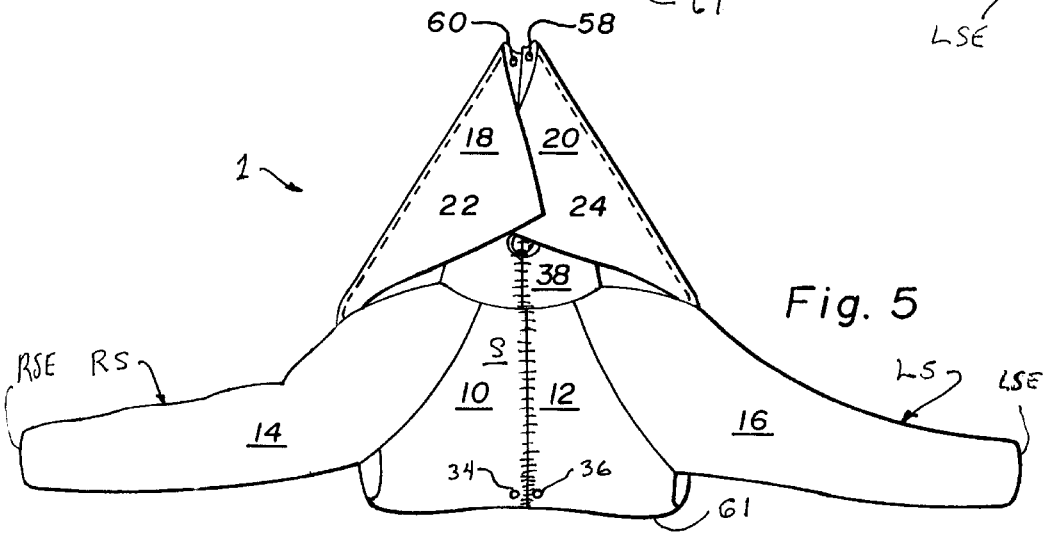
FIG. 5 illustrates the garment overlapped at both front fold lines, to the collar. Snaps on the interior of the front bottom sections are revealed.

FIG. 2 provides a view of coat 1 from the back. Left sleeve LS has a back section 48 and right sleeve RS has a back section which is designated 50. Thus the left sleeve LS is made up of sections 16 and 48 and the right sleeve RS by sections 14 and 50. A collar 38 is provided at the top of the coat. The back top sections are joined to back bottom 44 and back bottom 46 at a back fold line 56, which delimits the top and bottom sections. Sleeve fasteners 52 and 54 are located on sleeve back portions 48 and 50 near the bottom edges, and are made from a rigid material such as metal or plastic. The body section B extends from the lines 15 and 17 and includes the panels 10, 12, 18, 20, 40, 42, 44 and 46 and the collar 38. The flexible material of the body B may be folded along transversed lines 61 and 62 in approximately one thirds sections along the length of the body. (Dashed lines such as the lines 15, 17, 61 and 62 are indications of general division fold lines and need not have any physical structure such as stitching.) FIG. 5 shows snaps 58 and 60; concealed from ordinary view, on the inside of front bottom sections 18 and 20, at the bottom of the coat near the longitudinal zipper.

Operation

Figure 3:
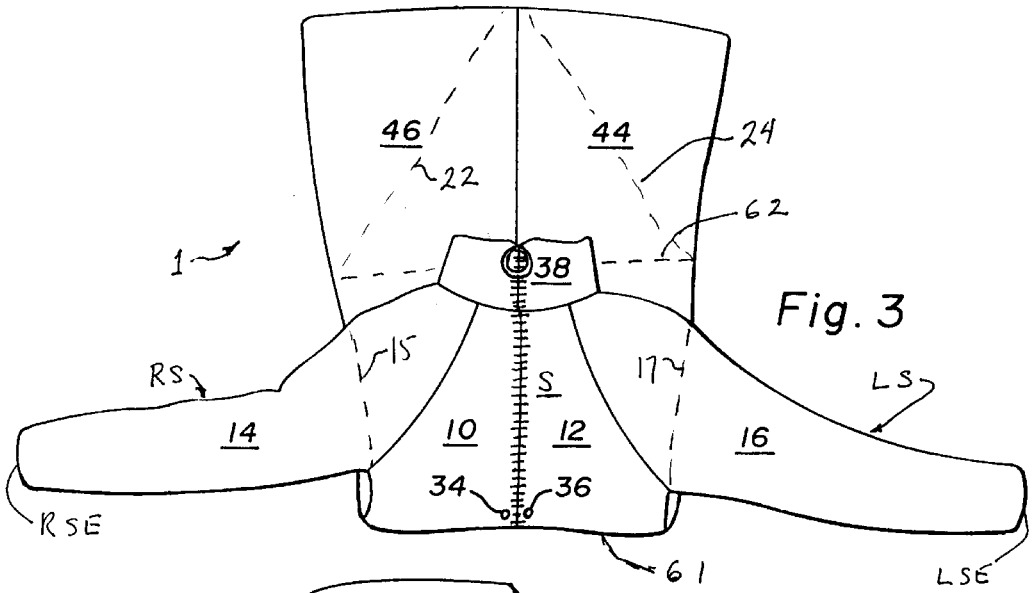
FIG. 3 illustrates the garment folded at the back fold line.

FIG. 3 illustrates the first step of coat 1 being converted into a tote bag. The coat 1 is first arranged to be in a flat spread-eagled array with the sleeves RS, LS to opposite sides as shown. The front portions 10 and 12 are placed downward with the top of said portions folded back at fold 61 (approximately at snap receptacles 34 and 36). Sleeves 14 and 16 are preferably extended approximately perpendicular to the body of the coat.

Figure 4:
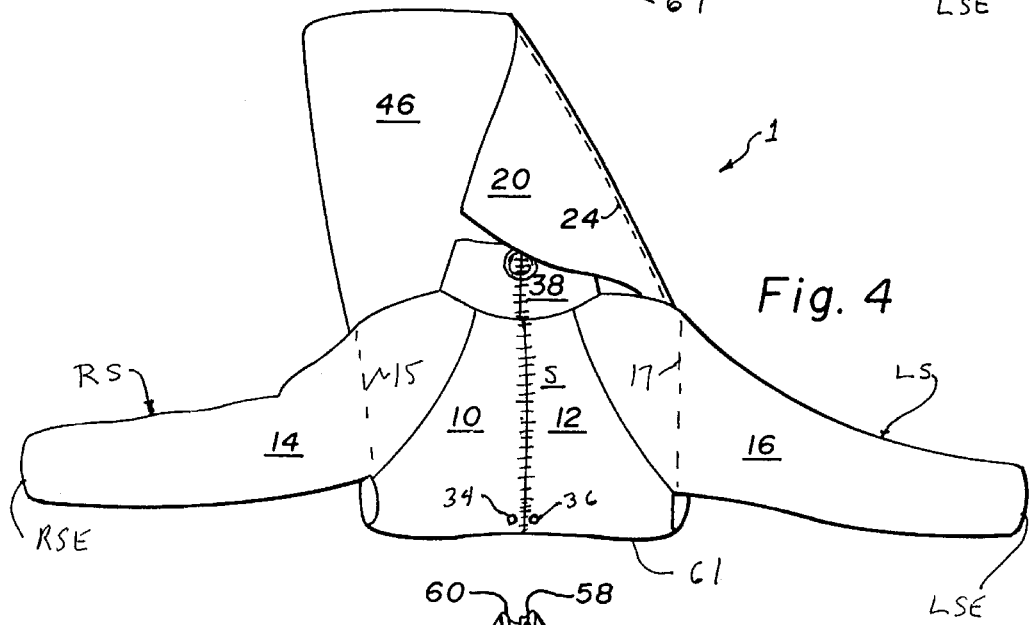
FIG. 4 illustrates the garment folded on a front fold line.

FIGS. 4 and 5 show front bottom sections 18 and 20 folded at diagonal fold lines 22 and 24, toward and overlapping collar 38. That is, the corners of the flat body B are folded over each other. Snaps 58 and 60 will be brought up to meet and connect with snap receptacles 34 and 36.

Figure 6:
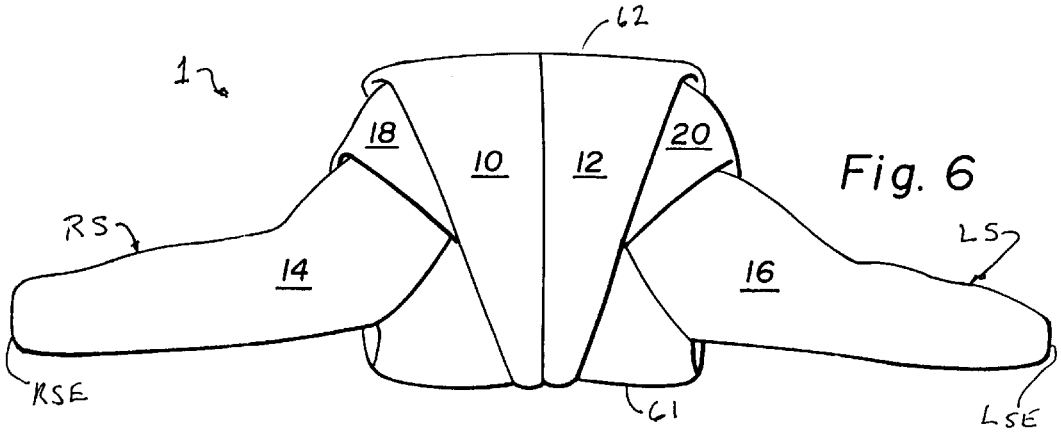
FIG. 6 illustrates the garment after mated fasteners (snaps) on the front portion's interior and exterior have been connected.
Figure 7:
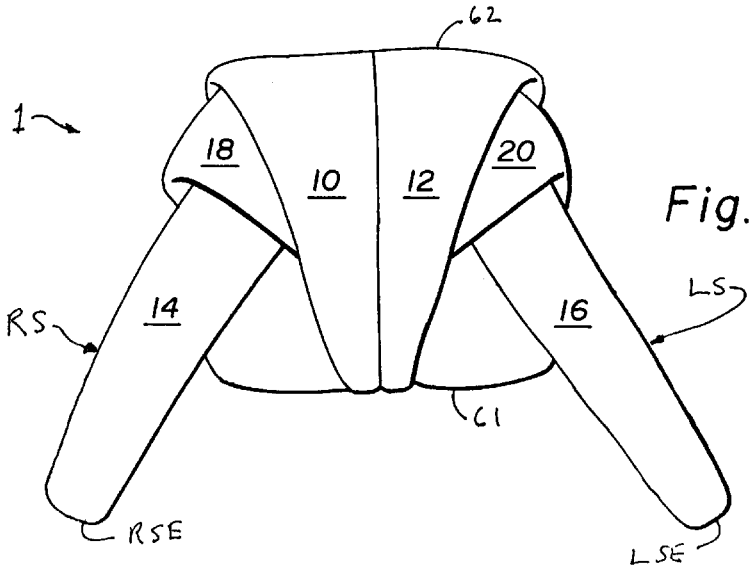
FIG. 7 illustrates the direction of sleeve movement.
Figure 8:
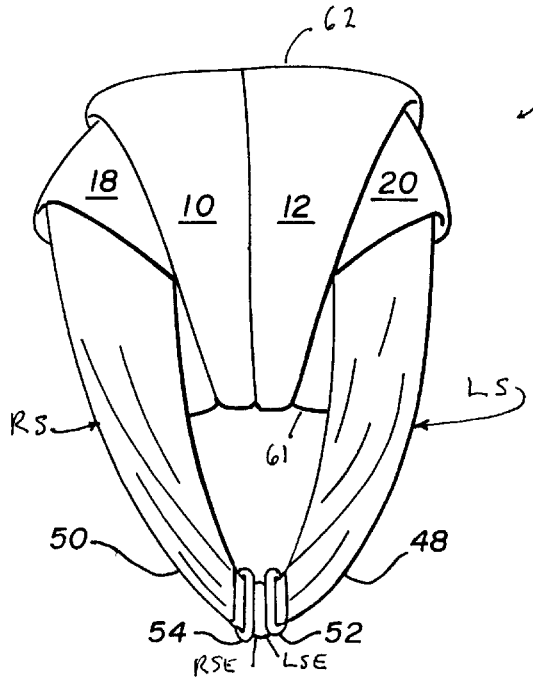
FIG. 8 illustrates fasteners at bottom edges of the sleeve back portions connected together. This is also a view of the back of the tote bag in an upside-down position.
Figure 9:
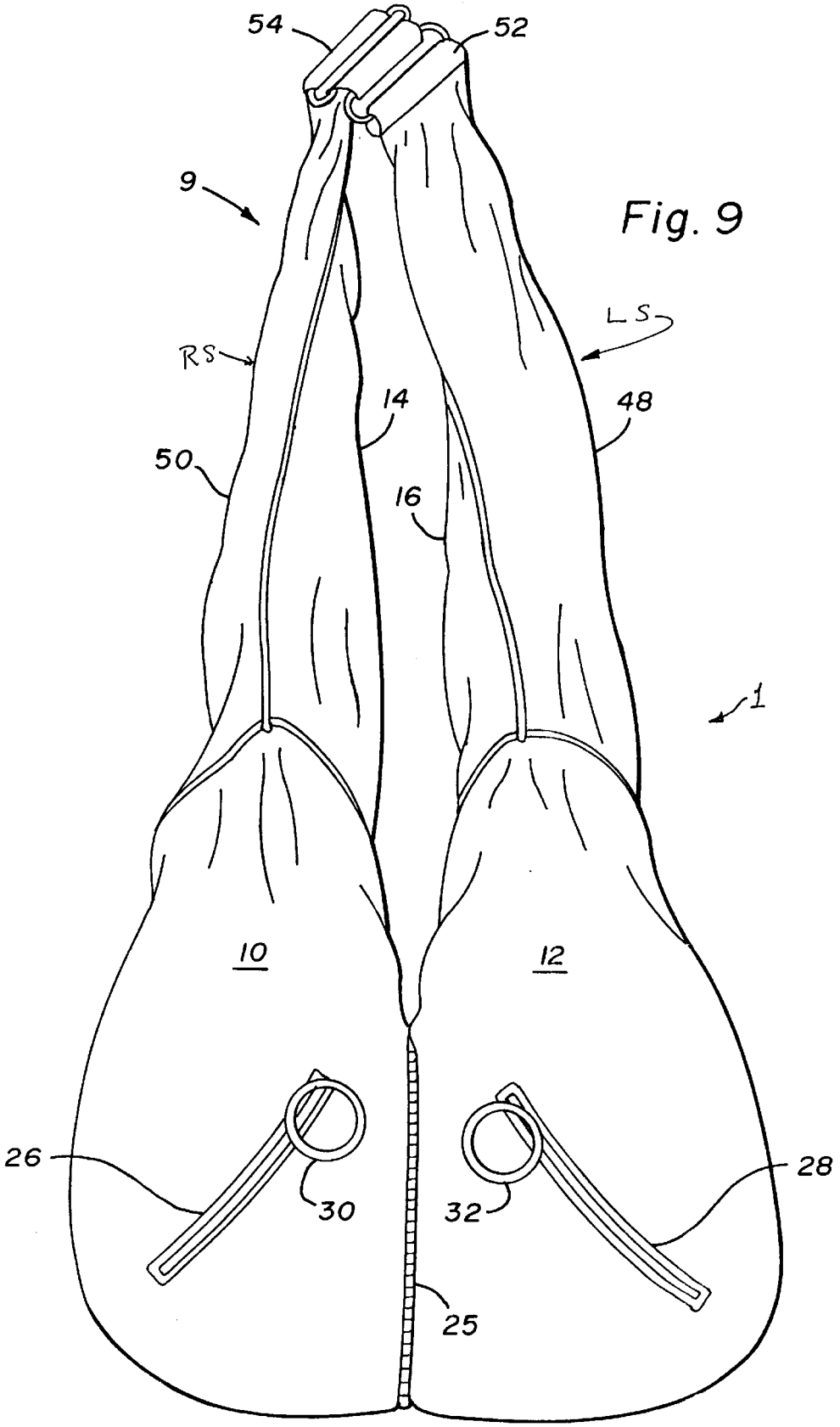
FIG. 9 illustrates the front of the preferred embodiment as a tote bag.

FIG. 6 illustrates the bottom of front tops 10 and 12 after FIG. 9 is a front view of the preferred embodiment of the invention as a tote bag. It may be carried by placing the fastened section over the shoulder of the user.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A coat made of flexible material which is converted into a shoulder tote bag and vice versa, comprising:

a coat body having a top with a head opening and an open bottom, a front portion and a back portion functionally connected to said front portion;

a left long sleeve and a right long sleeve each having one sleeve end functionally attached to said coat body near the top thereof and each having a free sleeve end, said sleeves being attached at respectively the left and right sides of the coat body near its top with a span of the back portion and front portion between the attached ends of the sleeve and the sleeves extending outward from said body on either side of said body;

folding means for allowing the body to be folded about said span between the sleeves of said body to form a bag with said sleeves extending on either side thereof and means for securing the body in the folded bag configuration; and means for fastening the sleeves together near their free ends to form a shoulder strap for the bag;

whereby the coat is convertible into a shoulder tote bag by folding its body about the span between the sleeves and fastening it into the folded array and the free ends of the left and right sleeves brought together and fastened together near their free ends to form a beltless shoulder strap.

2. A coat that is convertible into a shoulder bag and back to a coat for use by a human user having a shoulder and a side, said coat being made of flexible sheet material and having a body, two long sleeves functionally connected to said body, a top portion of the body spanning between the sleeves and connected to said body, said sleeves having a connected end and a free end; means at said free ends of said sleeves for releasably manually connecting the sleeves together to form a shoulder strap;

and fastening means on the body of said coat allowing the coat body to be fastened about said top portion when in a folded configuration, to form a compact bag-like arrangement having opposite sides, with the shoulder-strap-forming sleeves extending from said opposite sides, and said sleeves forming a loop therewith such that said shoulder-strap-forming sleeves may loop over and hang from the shoulder of the user with the bag-like arrangement at the user's side in the manner of a shoulder bag.

3. The convertible coat of claim 2 wherein:

said coat body includes at least two pockets having outside openings formed therein, which, when said body is folded into said bag-like arrangement about said top portion, said pocket openings are exposed on the outside of the bag and are accessible from the outside of said bag-like arrangement.

4. The convertible coat of claim 3, wherein said coat is a full length coat having a bottom skirt with bottom corner's and which, when the skirt is laid flat, the corner's foldable over each other to form a generally pointed arrangement.

5. The method of converting a coat into a shoulder bag wherein the coat is made of flexible material and has a body having a left side, a right side, a top with a head opening and an open bottom, a front portion and a back portion functionally connected to said front portion;

a left long sleeve and a right long sleeve each having one sleeve end functionally attached to said coat body near the top thereof and each having a free sleeve end, said sleeves being attached at respectively the left and right sides of the coat body near its top with a span of the back portion and front portion between the attached ends of the sleeve and the sleeves extending outward from said body on either side of said body;

each sleeve free end having a complementary mating fastener component thereon; said body including mating body fastening means;

comprising the steps of:

(a) laying the coat out in a flat array with the sleeves to either side of the body;

(b) folding the body transversely so as to bring the bottom of the body to overlay, in part, its front and to bring the mated fastening means together and to configure the body into a bag array with the sleeves extending to either side thereof;

(c) fastening the mated body fastening means;

(d) moving the free ends of the sleeves together; and (e) fastening the complementary sleeve fastener means together so as to form a shoulder strap.

6. The method of claim 5 further comprises folding the bottom corners of the coat inward between steps (a) and (b).

7. A garment comprising, a body of flexible material having a front, and a back, a pair of elongated sleeves extending from opposed sides of the body, said sleeves having releasable sleeve securing means adjacent an outer end of the sleeves, said body including body securing means, said body being foldable and releasably securable by said body securing means in a configuration of reduced dimensions with the sleeves projecting outwardly from the opposed sides of the folded body, and said sleeves being releasably secured together by the sleeve securing means into a shoulder strap so as to carry the folded garment in the configuration of a tote bag.

8. The garment of claim 7 including at least one pocket on an outer surface of the body which is exposed when the garment is in the tote bag configuration.

9. A method of converting a coat garment into a tote bag, said coat garment having functionally interconnected at least a front portion including a front top right with a snap fastener receptacle, a front top left with a snap fastener receptacle, a front bottom right with a hidden snap fastener means, a front bottom left with a hidden snap fastener means, a front fold line right, and a front fold line left; a back portion including a back top right, a back top left, a back bottom right, a back bottom left, and a back fold line; a collar; and sleeves, with outer free ends; each sleeve free end having complementary mating sleeve fasteners located near the outer free ends of the sleeves and which are joined in order to form a shoulder handle when the garment is converted into a tote bag comprising the steps of:

placing said front portion of the garment downward, folding along the back fold line so that the front top right and front top left are facing upward;

then lifting the front bottom left and front bottom right upward along the front fold line left and front fold line right so that the back bottom left and back bottom right are facing downward and approximately touching the collar;

then locating the hidden snap fastener means and lifting the front bottom left and front bottom right to connect with mating snap receptacles located on the front top left and front top right;

then lifting the sleeves to meet and lock the complementary mating sleeve fasteners together.

10. A garment convertible from a coat to a tote bag and vice versa, comprising:

a coat body having at least a front portion, a back portion attached to said front portion, and a left and a right sleeve portion extending therefrom, each of said sleeve portions having two ends with one end attached to said front and back portions and another free end which is not so attached, said coat having a top and bottom;

mated fastening means attached at said free ends of said sleeve portions of the coat for connecting together and thereby creating a shoulder strap carrying means of said tote bag; and the coat when laid out flat with said sleeve portions extending from said front portion and said back portion to either side thereof, being foldable along diagonal fold lines extending from either side of the center of the bottom of the coat to the sides of the coat so as to form a pointed bottom and being foldable along lateral lines so as to fold the pointed bottom of the coat to overlap the top of the coat and form a bag;

a plurality of mated fastening means located on said front portion to connect together and hold said coat in said fold position while said garment is being utilized as said tote bag; and wherein said front portion is separated into two halves by means of a zipper extending longitudinally on the garment and adapted to connect both halves of said front portion; and wherein said mated fastening means for holding the garment in its folded position includes a fastener located on an outside of said front portion immediately adjacent said longitudinal zipper at approximately one third of the length of the coat down said front, and further said mated fastening means includes a mating fastener located on said front portion near the bottom of the coat and immediately adjacent said longitudinal zipper.

* * * * *